US005875967A

United States Patent [19]

Ruth, III

[11] Patent Number: 5,875,967

[45] Date of Patent: Mar. 2, 1999

[54] METHOD AND APPARATUS FOR DISPENSING FLUID HAVING VOLATILE SOLVENT

[75] Inventor: Gustave Anthony Ruth, III, Old Saybrook, Conn.

[73] Assignee: The Lee Company, Westbrook, Conn.

[21] Appl. No.: 797,231

[22] Filed: Feb. 7, 1997

[51] Int. Cl.[6] ..... B05B 17/00

[52] U.S. Cl. ..... 239/1; 239/106; 346/140.1; 347/47

[58] Field of Search ..... 239/1, 106, 110, 239/119, 120, 602, DIG. 19; 346/140.1; 347/47, 85

[56] References Cited

U.S. PATENT DOCUMENTS

| | | | |
|---|---|---|---|
| 3,909,831 | 9/1975 | Marchio et al. | 346/140.1 |
| 4,054,883 | 10/1977 | Ozone | 346/140.1 |
| 4,278,983 | 7/1981 | Halasz | 347/47 |
| 4,291,317 | 9/1981 | Corwin et al. | 346/140.1 |
| 4,623,904 | 11/1986 | Conta et al. | 347/47 X |
| 5,392,989 | 2/1995 | Hurtig | 239/119 |

*Primary Examiner*—Andres Kashnikow
*Assistant Examiner*—Steven J. Ganey
*Attorney, Agent, or Firm*—Philip J. Lee

[57] ABSTRACT

A method and apparatus for preventing nozzle clogging in systems for dispensing fluids that comprise a suspension or solution of solid particles in a volatile solvent, such as ink jet printing systems consisting of a control valve and a nozzle, the method comprising causing the solvent to withdraw from the nozzle by increasing diffusion of the solvent from the system at a point distal from the nozzle by means of inserting, between the nozzle and the control valve, a section of tubing that is semipermeable to the solvent, and the apparatus comprising the usual dispensing system with the addition of a semi-permeable tube between the control valve and the nozzle.

23 Claims, 3 Drawing Sheets

METHOD AND APPARATUS FOR DISPENSING FLUID HAVING VOLATILE SOLVENT

BACKGROUND OF THE INVENTION

A. Field of invention

The present invention relates generally to methods and apparatus for fluid dispensing, and more particularly to a new and improved method of dispensing fluids consisting of solutes dissolved or particles suspended in a volatile fluid dispersion medium and the apparatus used for employing such method.

B. Description of Related art

The present invention relates to methods and systems for dispensing fluids from a nozzle, meaning an orifice of limited size, wherein the nature of the fluid being dispensed is such that evaporation of the fluid dispersion medium may cause solid matter to be deposited at the nozzle, leading to clogging. An example of such a system is an ink jet printing system. In its simplest form, a fluid dispensing system, such as an ink jet printing system, will include a flow control means, such as a control valve, and a nozzle connected to the flow control means by a fluid conduit. It is frequently desirable to employ a nozzle that is of a relatively small bore and often one that is of a smaller bore than the fluid conduit. Increased print resolution is achieved, in part, by reduction in volume of ink dispensed in an operational cycle of an ink jet printing system, frequently requiring a reduction in the size of the nozzle bore. The limits of print legibility requires systems used in the field of ink jet printing to perform precisely and at high frequencies with uniformly replicable results. In addition, the ink dispensed by an ink jet printing system generally consists of a fluid dispersion medium with dissolved solute or suspended particles, generally solid pigmentation. It has been found that when the fluid dispersion medium of the ink is volatile, ink jet printing systems are often subject to clogging of the nozzle. The method and apparatus of the present invention were developed in response to the specific problems of ink jet printing system failures, and for that reason, ink jet printing systems are used as the model for description of the method and apparatus of the present invention which is intended to prevent the problem of clogging nozzles in such systems. Use of the ink jet printing model is not intended to limit the applicability of the method to that field, and it is anticipated that the invention can be successfully utilized in other circumstances. For the sake of brevity, the term solvent is used to refer to any fluid dispersion medium whether a solvent of a solution or the fluid base of a suspension, as the invention is applicable in both cases.

In the process of ink jet printing, it is necessary to accurately control the deposition of ink on the object over a distance which requires a mechanism to send the ink at a high velocity in order to travel to the print material. In many cases multiple nozzles are used in an array and the degree of resolution that can be achieved by a printing system depends upon the number and size of the nozzles as well as the density of the nozzle array. It is frequently desirable to pack the nozzles in a tight array with each of the nozzles in the array being connected to a control valve that is offset from the nozzle array. Since the control valves are frequently larger than the nozzles, the separation of valves from the nozzle array allows dense nozzle packing. In addition, the offset of the valves from the nozzle array provides added flexibility and convenience in construction and maintenance. The distance of the offset of the valves from the nozzle array is a design variable determined by the particular physical characteristics of the system components. A section of flexible tubing is commonly used as the fluid conduit to complete the connection between each control valve and the respective nozzle controlled by it. For ordinary engineering concerns, the obvious choice for the material of such tubing is a material that is impervious to the fluid being handled.

The operational cycle of a simple unit in such systems involves the opening of the control valve which allows the ink source pressure to expel ink from the nozzle, followed by the closing of the control valve which isolates the nozzle from the source pressure and the flow of ink stops. The system units are operated at high frequencies such that ink is dispensed one drop at a time. Preferably the outer end of the nozzle is left open to the atmosphere to allow its use at any time, and when the control valve is closed, the ink not expelled is retained in the nozzle by surface tension.

The ink used in ink jet printing generally comprises pigmented solids or solutes suspended or dissolved in a solvent base. Solvents of relatively low volatility such as water or oil are commonly used in ink jet printing on porous, absorbent materials such as cardboard, the solvent being rapidly absorbed into the substrate to present a dry surface in a relatively short time. However, for ink jet printing on nonporous media, such as plastic, metal or coated cardboard surfaces, more highly volatile solvent is necessary to avoid running and smudging. Methyl Ethyl Ketone ("MEK") is a volatile solvent frequently used for printing on non-absorbent, smooth surfaces and has the advantage of being able to wet many surfaces that will not accept other solvents. A disadvantage to the use of volatile solvents such as M.E.K. is a frequently encountered problem of nozzles that become clogged when not in use for a relatively short period of time. When the system is not in use, the evaporation of the solvent through the open end of the nozzle results in a scab that can thicken into a plug that clogs the nozzle. While evaporation caused clogging may occur over sufficient time with any solvent that is subject to evaporation, it has been found that an ink jet printing system that performs acceptably with less volatile solvent based inks, becomes clogged when a MEK based ink is used and the system is turned off in the normal course of operation. It is believed that the formation of the solid plug occurs in a conventional system using impervious tubing because all evaporation of the ink solvent occurs across the surface of the meniscus at the nozzle orifice and that the speed of the withdrawal of the meniscus from the nozzle orifice is slow enough that the meniscus gradually stops, and the interface gradually thickens as ink is drawn to the interface and ink solids are continuously left at the interface by the evaporation of the ink solvent. This understanding of the process of plug formation in prior art systems is illustrated in FIG. 1. which shows a conventional tube and nozzle arrangement. In FIG. 1, the tubing is identified by the numeral 11, the nozzle is identified by the numeral 13, and the ink within the tube 11 is identified by the numeral 31, with the successive ink-air interfaces identified by numerals 1 through 6 respectively. As illustrated in the Drawings, the inside diameter of the nozzle is typically smaller than that of the tubing and is therefore more prone to clogging. In such conventional systems, it is believed that, over time, the ink solvent is drawn out through the interface, and all or much of the ink solids will be deposited at or in the nozzle.

Operating a conventional ink jet printing system with volatile solvents may require preventative routine maintenance or a specific operational sequence including a start-up sequence or a purging sequence to eliminate the plug at the nozzle. Other attempted solutions include covering or continuously wetting the orifices when inactive. Such adaptations involve extra steps not normally part of the ink jet printing process and are time consuming and not particularly effective. Another alternative is to attempt to resist nozzle clogging by reducing the volume of ink in the fluid conduit by shortening the fluid conduit or by integrating the nozzle into the valve to eliminate the fluid conduit. Elimination of the conduit between the nozzle and valve requires the construction of a preassembled manifold with the highest nozzle density possible, often slanting the valve-nozzle assembly to achieve greater density. The purpose of such an arrangement is to minimize the passage to the nozzle orifice to minimize the volume of ink subject to evaporation to reduce the size of the pigment scab to a size that will not plug the nozzle. Integrated systems are relatively costly to construct and the individual components are not easily, if at all, replaced or serviced. In addition a size limitation is imposed by the inability to offset the valves from the nozzle array. Simply shortening the fluid conduit does not eliminate the design limitations. As stated above, the reduction of the fluid conduit places limitations on the minimum proximity of the nozzles since the valve size determines the spacing of the smaller nozzles. Therefore, print resolution is expected to suffer unless the valves and nozzles are separated by a substantial length of fluid conduit.

SUMMARY OF THE INVENTION

The present invention comprises an improved method of dispensing a fluid suspension or solution having a volatile solvent, such as in ink jet printing, whereby each control valve is spatially separated from a corresponding nozzle and connected to the nozzle by a fluid conduit formed of a substance that is partially permeable by the volatile fluid solvent. In general, the method diverges from the conventional method by allowing and promoting the diffusion of the fluid solvent through the wall of the fluid conduit to evaporate into the atmosphere rather than attempting to limit or prevent the evaporation of the fluid solvent. The result of the diffusion and evaporation of the fluid solvent through the tubing wall is the prevention of the formation of a thick nozzle plugging scab at the nozzle orifice. The method of the present invention has been found to prevent nozzles from becoming plugged during periods of inactivity, and it is believed that a reason for this result is that the diffusion of the ink solvent through the tubing wall withdraws the meniscus, comprising the air-fluid interface which initially traverses the nozzle aperture, from the nozzle aperture at a speed sufficient to prevent the formation of a plug by the solids that are left behind in the nozzle by evaporation through the nozzle aperture. The solid particulate is left in the tubing but it is spread over the length of the tube and does not form a thick transverse plug at any point. As the solvent diffuses through the tubing wall, the solvent molecules become gaseous as they approach the outer wall surface and disperse into the atmosphere. In the present invention, the volume of solvent available for evaporation through the meniscus is reduced by the diffusion through the tubing wall. The removal of the meniscus from the nozzle by the method of the present invention reduces the amount of solid particulate or precipitate deposited at the nozzle. The rate of the fluid solvent diffusion through the tubing wall controls the success of the method and the rate of diffusion depends upon the geometry of the tubing and upon the diffusivity of the tube material, relative to the chosen solvent. FIG. 2 illustrates the withdrawal of the ink meniscus from the nozzle in a system using semipermeable tubing according to the present invention. The method and apparatus of the present invention allows the nozzle to remain unclogged while the system is shut down and the fluid solvent left in the system, exposed to the atmosphere to evaporate. When the system is reactivated to print again, the solvent of the fresh ink in the tubing dissolves pigment deposits and carries off the residue left on the inside of the tubing and the system is washed completely. The method of the present invention thereby simplifies the ink jet printing system by eliminating the necessity of using purging or washing cycles to avoid the pigment plug at the nozzle. A further benefit of the increased resistance to, or elimination of clogging without eliminating the tubing between the valve and the nozzle is that the nozzles can be arranged in closer proximity than would otherwise be possible due to the possibility to offset the bulkier valves. It is anticipated that other volatile solvent based fluid dispensing systems could benefit by the use of the semi-permeable fluid conduit in accordance with the method of the present invention. It is also anticipated that a variety of methods and apparatus can be utilized to provide the solvent diffusion necessary to prevent clogging at the nozzle orifice. Therefore, the method and apparatus of the present invention is not limited to the use of semi-permeable tubing although that is the means found to be preferable for ink jet printing systems. Other means might include use of membranes or drains to remove the fluid from the system, or at least from the nozzle.

The principal aim of the present invention is to provide a new and improved method of ink jet printing which meets the foregoing requirements and which is capable of printing with highly volatile solvent based inks without clogging when inactive.

Another and further object and aim of the present invention is to provide a new and improved method of ink jet printing which meets the foregoing requirements and which is capable of printing with highly volatile solvent based inks and is economical to manufacture, maintain and operate.

Yet another and further object and aim of the present invention is to provide a new and improved method of ink jet printing which meets the foregoing requirements and which allows the placement of ink jet nozzles in close proximity to each other.

Yet another and further object and aim of the present invention is to provide a new and improved apparatus for carrying out the method of the present invention.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

DESCRIPTION OF THE PREFERRED EMBODIMENT(S)

Figure 1:
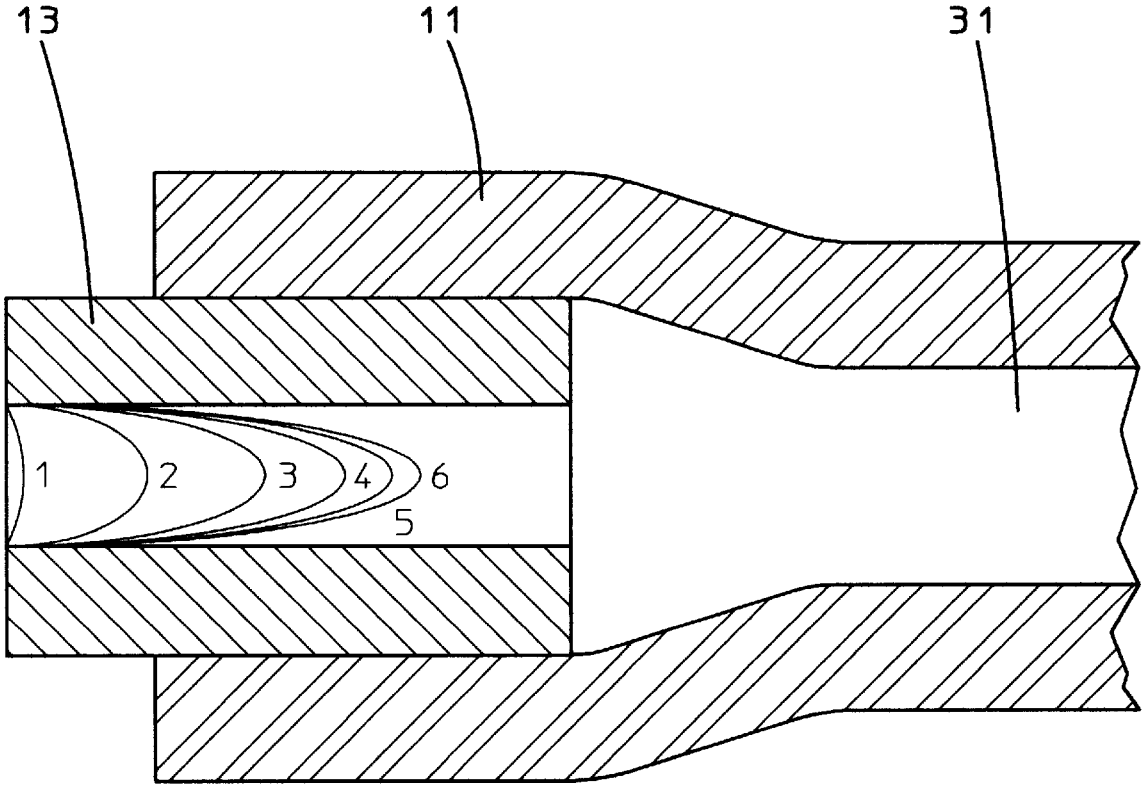
PRIOR ART FIG. 1
FIG. 1 is a sectional view of a partial, conventional ink jet apparatus consisting of a nozzle and connecting tubing showing the progressive locations of the ink-air interface in the inactive system.
Figure 3:
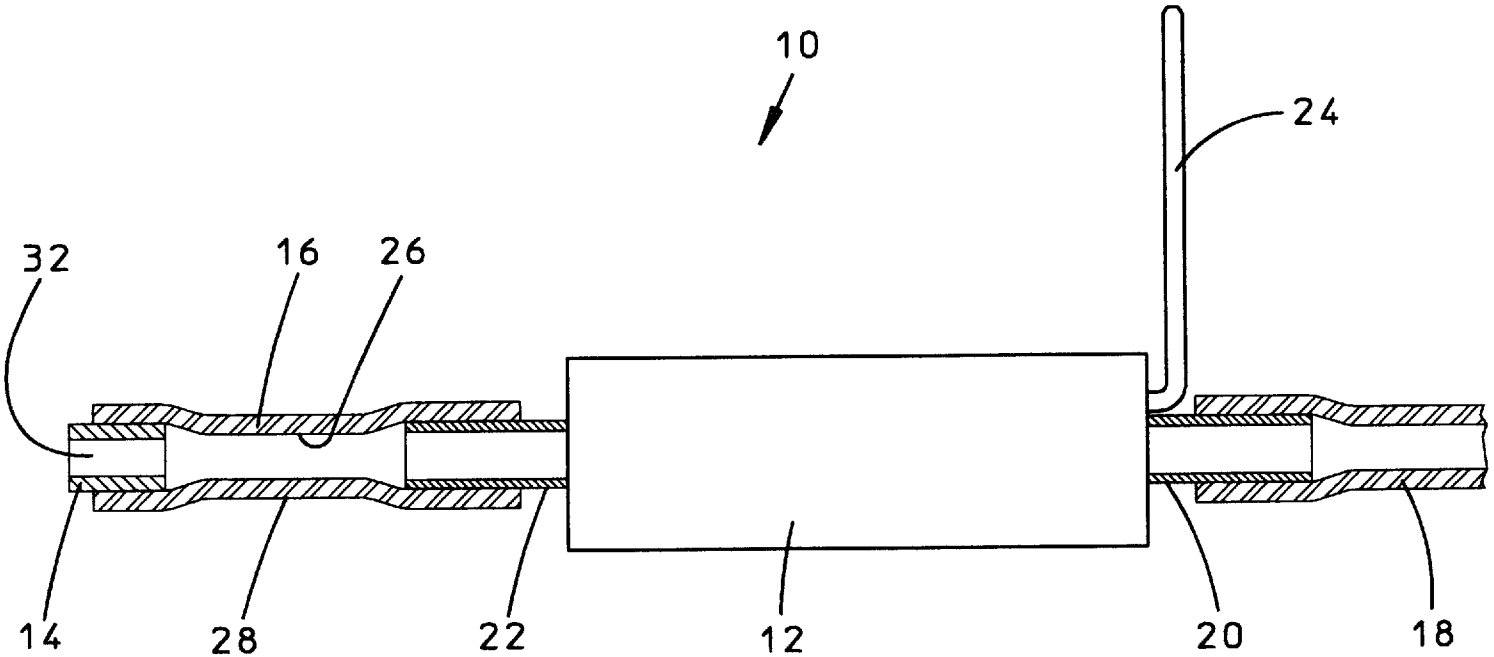
FIG. 3 is a partial sectional view of a preferred embodiment of the present invention.

With reference to the Drawings wherein like numerals represent like parts throughout the Drawings, an ink jet printing unit for ink jet printing in accordance with the method of the present invention is generally designated by numeral 10 in FIG. 3. As will be described in more detail below, the preferred embodiment of the present invention differs from the prior art unit shown in FIG. 1, in the materials used to form the components thereof.

The present invention comprises an improved method of dispensing a fluid that consists of a suspension or solution having a volatile liquid dispersion phase or medium, herein called a solvent, and a suspended or dissolved component that will precipitate in a solid phase when the solvent is reduced, for example by evaporation. The method of the present invention has been beneficially used with fluids using alcohol or methyl ethyl ketone ("MEK") based solvents. Each unit 10 of the apparatus for such method comprises a control valve 12 having an inlet port 20 and an outlet port 22, outlet port 22 being connected to a nozzle 14 by a fluid conduit 16. Control valve 12 is electrically controlled and operated by means of electrical leads 24. The method of the present invention comprises the prevention of the formation of a nozzle clogging plug of formerly suspended particles or formerly dissolved solute by means of the step of causing the fluid being dispensed to leave the reduced diameter internal bore 32 of the nozzle 14 when the control valve 12 is closed. The preferred method provides a method for reducing the volume, within the fluid conduit 16, of the fluid being dispensed by forming the fluid conduit 16 of a substance that is at least partially permeable to the fluid dispersion medium. More specifically, the fluid conduit 16 is formed so as to allow the diffusion of the portion of the fluid dispersion medium that is in the fluid conduit 16, through the material of the fluid conduit 16, and the subsequent evaporation of the medium into the atmosphere. The method of the present invention is particularly beneficially employed as a method of ink jet printing but may be employed in other fields as well.

Figure 2:
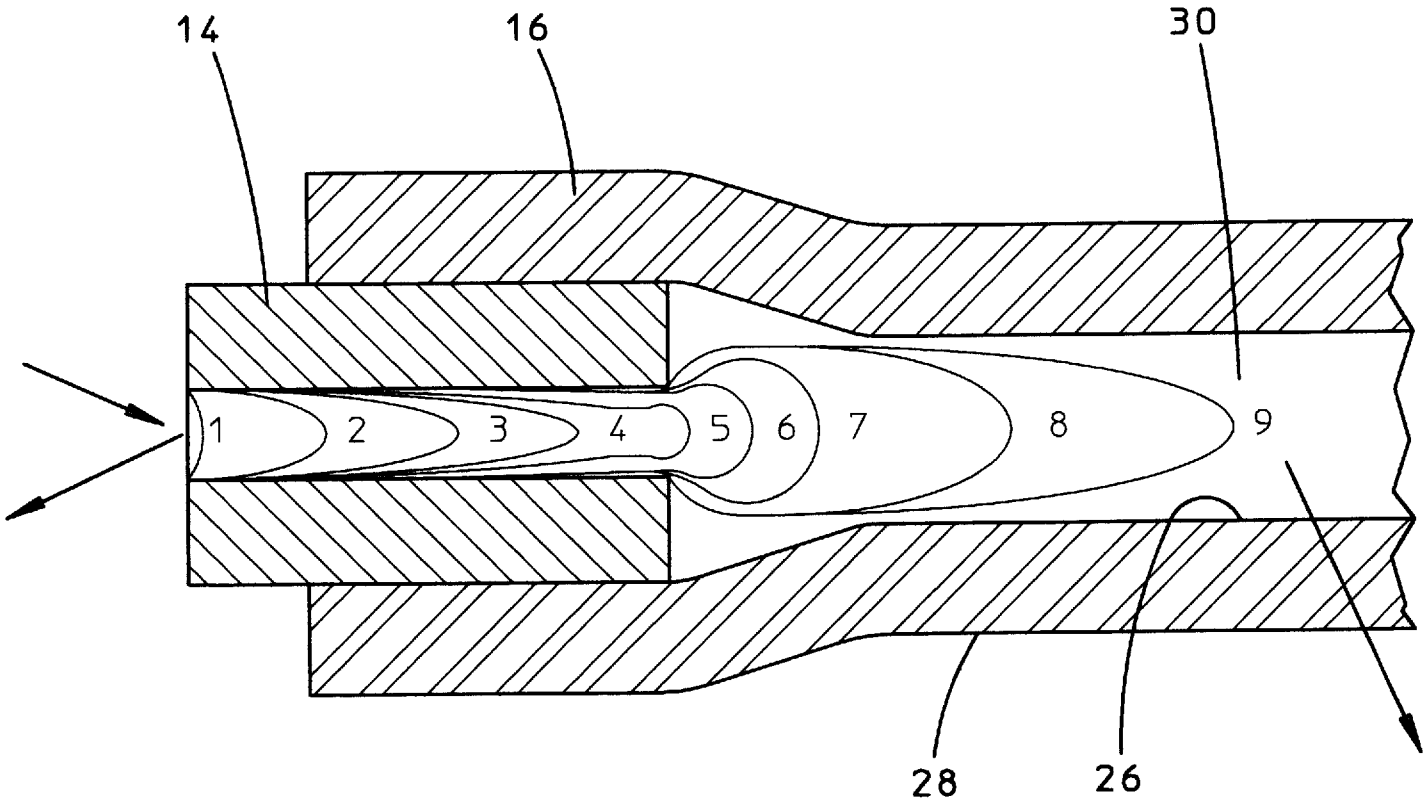
FIG. 2 is a sectional view of a partial ink jet apparatus in accord with the present invention, consisting of a nozzle and connecting tubing showing the progressive locations of the ink-air interface in the inactive system.

As an example of the method and apparatus of the present invention, the preferred embodiment of the present invention as used in an ink jet printing system is illustrated in the FIGS. 2 and 3 and described herein. The illustrated preferred embodiment of the invention is specifically designed for use with methyl ethyl ketone ("MEK") based inks in a normal environment of normal room temperature, sea level atmospheric pressure and without special ventilation. Fluid conduit 16 is a section of tubing formed of black extruded ethylene-propylene terpolymer rubber (commonly referred to as "EPDM rubber"), 70 Durometer, having a nominal wall thickness of 0.0225 inches with a nominal inside diameter of 0.027 inches and a length of 0.5 inches. The material of fluid conduit 16 does not allow passage of ink solids through the side of fluid conduit 16, but is sufficiently permeable to allow the MEK solvent of ink 30 to diffuse through the inner wall 26 of fluid conduit 16 and to undergo a phase change such that the ink solvent transpires through the outer surface 28 of fluid conduit 16 into the atmosphere in a gaseous state, without leaking liquid MEK directly. Control valve 12 is connected to an ink source (not shown) by means of a supply tube 18 that is connected to the inlet port 20 of control valve 12. Supply tube 18 is preferably formed of material that is relatively impermeable to the solvent of ink 30 used in the system 10. Commonly used materials for supply tube 18, or other system tubing other than outlet fluid conduit 16 include butyl rubber and Teflon, FEP or PTFE products. Other than in the specific instance of fluid conduit 16, it is generally preferable to limit or prevent loss of ink 30 or its solvent by using relatively impermeable materials.

In the preferred embodiment, the ink supply pressure is about 8.0 psi. above atmosphere. However the supply pressure may change according to the exact system performance requirements. The supply pressure does not affect the outcome of the method of the present invention, ie. the prevention of the formation of a plug in the nozzle 14, as plug formation occurs after the control valve 12 closes isolating nozzle 14 from the supply pressure. Nozzle 14 is a section of polished glass tubing with an inside diameter of about 0.010 inches and a length of about 0.12 inches.

It will be appreciated and anticipated that the success of the method and apparatus of the present invention can be affected by a number of extraneous factors such as ambient air flow, temperature and pressure as well as design factors such as the size and thickness of the fluid conduit 16. Further variations in performance will be anticipated from variations in ink composition and in tubing material or configuration. In general, variations that tend to increase diffusion and vaporization of the ink solvent, such as increased air flow or temperature, increased permeability or surface area of fluid conduit 16, decreased tubing wall thickness, decreased atmospheric pressure, or decreased ink solid concentrations, will tend to aid in the prevention of plug formation. Conversely, variations that tend to decrease diffusion and vaporization of the ink solvent, such as decreased air flow or temperature, decreased permeability or surface area of fluid conduit 16, increased tubing wall thickness, increased atmospheric pressure, or increased ink solid concentrations, will generally tend to decrease the effectiveness of the present invention in the prevention of plug formation. It is believed that the effectiveness of the present invention in plug prevention depends upon the air-ink interface withdrawing from the nozzle orifice at a sufficient velocity to at least withdraw past the immediate vicinity of the nozzle before the ink surface solidifies and withdrawal stops. It is further believed that the effect of the transpiration of the ink solvent is similar to mass transfer in a cylindrical tube such that a useful quantification of the velocity (V) of withdrawal of the air-ink interface from the nozzle is believed to be approximated by the following equation:

$$V = \frac{1}{\rho A}\left[ m_s + \frac{2\pi L D_{AB}}{\ln\left(\frac{r_2}{r_1}\right)} (p_1 - p_2) \right]$$

where:

L=Length of fluid conduit 16

$D_{AB}$=Mass diffusivity of ink solvent 30

$r_1$=Internal radius of fluid conduit 16

$r_2$=Outside radius of fluid conduit 16

$p_1$=Species density at internal wall 26 surface $p_2$=Species density at outer surface 28

A=Cross-sectional area inside nozzle 14

$m_s$=Evaporation rate through the air-ink interface.

ρ=Density of ink 30

The foregoing equation takes into account the geometry of the illustrated preferred embodiment and changes in the geometry of the system would require adaptation of the formula to account for other configurations of the semipermeable surface.

The foregoing equation is not intended to necessarily return a precise absolute value for the speed of the ink surface withdrawal. Rather, this equation is useful in approximating the effect of varying the numerous variables to change the time required for the ink surface withdrawal from the nozzle. It is anticipated that the usual application is to determine a modification of an existing system to increase the speed of the ink surface withdrawal to prevent formation of a nozzle clogging plug of solids. Accordingly, in circumstances in which plugging occurs in systems using a given ink, plugging can be reduced in accord with the method of the present invention by making modifications to the system to increase the velocity of the ink-air interface by any or all of the following measures:

1. increasing the total permeability of the semipermeable outlet fluid conduit 16 by
   - A. changing the material of the semipermeable section, eg. outlet fluid conduit 16, to use a material that is more permeable to the solvent being used; or
   - B. increasing the surface area of the semipermeable membrane, eg. by lengthening outlet fluid conduit 16; or
   - C. decreasing the thickness of the wall of outlet fluid conduit 16; or
2. decreasing the cross-sectional area of the inside of nozzle 14; or
3. increasing the rate of solvent diffusion by
   - A. dispersing the solvent from the outer surface 28 of fluid conduit 16, by increasing air flow over outer surface 28; or
   - B. reducing the atmospheric pressure on the outer surface 28; or
   - C. increasing the ambient temperature; or
   - D. using a more volatile solvent. In addition, shortening the length of the nozzle can be expected to reduce the time required for the ink surface to withdraw from the nozzle.

It should be appreciated and anticipated that while fluid conduit 16 in the illustrated preferred embodiment is formed of EPDM rubber, a variety of materials could be used with satisfactory, but different results, provided such other materials were sufficiently diffusible by the fluid dispersion medium to be used.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A method of dispensing from a system having a nozzle and a flow control means, a fluid mixture consisting of a volatile solvent and suspended or dissolved particles, the method comprising the step of causing the fluid mixture to withdraw from the nozzle when the fluid is not being dispensed by evaporation of the solvent of the fluid mixture present between the control means and the nozzle.

2. The method of claim 1 wherein the step of causing the fluid mixture to withdraw from the nozzle further comprises inserting between the flow control means and the nozzle, a section of material that is semipermeable to the solvent of the fluid mixture.

3. The method of claim 2, wherein the step of inserting a section of semipermeable material further comprises using a tubular section of semipermeable material.

4. The method of claim 3, wherein the step of inserting a section of semipermeable material further comprises selecting the material of the tubing to be semipermeable to methyl ethyl ketone.

5. The method of claim 4, wherein the step of selecting the material for the section of semipermeable material further comprises selecting ethylene-propylene terpolymer.

6. A method of dispensing a fluid mixture consisting of a volatile solvent and a suspended or dissolved particulate phase from a system, the method comprising the steps of inserting between a nozzle and a flow control means, a section of fluid conduit and increasing the total permeability of the fluid conduit to the solvent.

7. The method of claim 6, wherein the step of increasing the permeability of the fluid conduit further comprises forming the conduit of material of greater permeability to the solvent.

8. The method of claim 7, wherein the step of increasing the permeability of the fluid conduit further comprises forming the conduit of ethylene-propylene terpolymer tubing.

9. The method of claim 7, further comprising the step of increasing the rate of solvent diffusion through the material of the fluid conduit.

10. The method of claim 9, wherein the step of increasing the rate of solvent diffusion through the material of the fluid conduit further comprises dispersing the solvent from the outer surface of the fluid conduit.

11. The method of claim 10, wherein the step of increasing the rate of solvent diffusion through the material of the fluid conduit further comprises increasing air flow over outer surface of the fluid conduit.

12. The method of claim 11, wherein the step of increasing the rate of solvent diffusion through the material of the fluid conduit further comprises reducing the atmospheric pressure on the outer surface of the fluid conduit.

13. The method of claim 12, wherein the step of increasing the rate of solvent diffusion through the material of the fluid conduit further comprises increasing the system temperature.

14. The method of claim 13, wherein the step of increasing the rate of solvent diffusion through the material of the fluid conduit further comprises using a more volatile solvent.

15. The method of claim 6, wherein the step of increasing the total permeability of the fluid conduit further comprises lengthening the fluid conduit.

16. The method of claim 6, wherein the step of increasing the total permeability of the fluid conduit further comprises decreasing the thickness of the wall of the fluid conduit.

17. The method of claim 6, wherein the step of increasing the total permeability of the fluid conduit further comprises increasing the surface area of the fluid conduit.

18. A method of ink jet printing using ink having a volatile solvent in a system having a nozzle, an ink supply and a flow control means therebetween, the method comprising the steps of forming a fluid conduit of material that is more permeable to the ink solvent, and inserting the fluid conduit between the nozzle and the flow control means.

19. The method of claim 18, wherein the step of forming the fluid conduit further comprises forming the fluid conduit of ethylene-propylene terpolymer tubing.

20. An apparatus for dispensing fluids that comprise a volatile solvent, the apparatus comprising a nozzle, a fluid supply, a control valve between the nozzle and the fluid supply, and a fluid conduit connected between the nozzle and the control valve, the fluid conduit being formed of a material that is semipermeable by the volatile solvent.

21. The apparatus of claim 20, wherein the apparatus is suitable for ink jet printing and the fluid being dispensed is ink.

22. The apparatus of claim 21, wherein the material of the fluid conduit is semipermeable to methyl ethyl ketone.

23. The apparatus of claim 22, wherein the material of the tubing is ethylene-propylene terpolymer.

* * * * *